US007367593B2

(12) United States Patent
Wicker

(10) Patent No.: US 7,367,593 B2
(45) Date of Patent: May 6, 2008

(54) SECURITY DOCUMENTS AND A METHOD AND APPARATUS FOR PRINTING AND AUTHENTICATING SUCH DOCUMENTS

(75) Inventor: Thomas M. Wicker, Lakeville, NY (US)

(73) Assignee: Adler Tech International, Inc., Toronto (CA)

( * ) Notice: Subject to any disclaimer, the term of this patent is extended or adjusted under 35 U.S.C. 154(b) by 687 days.

(21) Appl. No.: 10/205,812

(22) Filed: Jul. 26, 2002

(65) Prior Publication Data

US 2003/0030271 A1 Feb. 13, 2003

Related U.S. Application Data

(60) Provisional application No. 60/309,175, filed on Aug. 2, 2001.

(51) Int. Cl.
*B42D 15/00* (2006.01)

(52) U.S. Cl. ..... 283/113; 283/72; 283/93

(58) Field of Classification Search ..... 283/72, 283/81, 93, 94, 113, 114, 117; 428/40.1, 428/42.1, 195.1, 915, 916
See application file for complete search history.

(56) References Cited

U.S. PATENT DOCUMENTS

| | | | | |
|---|---|---|---|---|
| 1,002,600 | A * | 9/1911 | Morris et al. | 283/70 |
| 4,033,059 | A * | 7/1977 | Hutton et al. | 283/91 |
| 4,588,212 | A | 5/1986 | Castagnoli | 283/91 |
| 4,715,623 | A | 12/1987 | Roule et al. | 283/91 |
| 5,487,567 | A | 1/1996 | Volpe | 283/72 |
| 5,722,693 | A * | 3/1998 | Wicker | 283/67 |
| 5,974,150 | A * | 10/1999 | Kaish et al. | 713/179 |
| 6,222,650 | B1 | 4/2001 | Long | 359/2 |
| 6,296,281 | B1 * | 10/2001 | Stone | 283/93 |
| 2003/0015866 | A1 * | 1/2003 | Cioffi et al. | 283/72 |

* cited by examiner

*Primary Examiner*—Dana Ross
(74) *Attorney, Agent, or Firm*—Grossman, Tucker, Perreault & Pfleger, PLLC

(57) ABSTRACT

A security document and a method of making and authenticating the document in which the document contains a security feature of an image/background pattern printed in one subtractive color on the document and at least one other but different image/background pattern printed in another subtractive color superimposed directly over the one image/background pattern.

21 Claims, 7 Drawing Sheets

SECURITY DOCUMENTS AND A METHOD AND APPARATUS FOR PRINTING AND AUTHENTICATING SUCH DOCUMENTS

CROSS-REFERENCE TO RELATED APPLICATIONS

This application claims the benefit of U.S. Provisional Patent Application No. 60/309,175, filed Aug. 2, 2001.

FIELD OF THE INVENTION

The present invention relates document security features, a method for printing such security features on documents, and a method and apparatus for authenticating such security documents as original documents.

DESCRIPTION OF THE RELATED ART

Many methods and products have been developed to stymie and/or thwart the unauthorized reproduction of original valuable documents, such as currency, travelers checks, licenses, passports, and personal identification papers, to deter illegal activities such as counterfeiting. Generally, these methods and products are intended to enable unauthorized copies of original documents to be readily distinguished from the originals. Examples of such methods and products include currency or bank notes that are printed on special paper having a unique feel or texture, embedded images and/or moire generating patterns in the original documents, originals with fine text, e.g., microprint, and other details that are not easily reproduced by copiers, and placing difficult-to-reproduce watermarks or holographic images on the originals.

However, advancing computer and photocopying technologies have rendered many of the above-described document protection methods substantially less effective and have forced the use of advanced, more expensive and complicated document protection techniques, such as holographs. These advanced techniques take substantial time to develop and implement, and may be relatively inflexible and difficult to revise in an expedient manner. They also are likely to be similarly rendered ineffective by advancing computer and copier technology, but within a period of time which does not permit recovery of the cost of development and implementation. The inflexibility and/or limited adaptability of the advanced techniques may result in relatively lengthy periods of time during which the security of original documents may be vulnerable or compromised. Additionally, many of the above-described document protection methods generally focus on detecting unauthorized copies of an original document rather than providing a method that readily authenticates an original document as an original.

Therefore, what is needed in the art is a document protection method and apparatus that enables an original security document to be simply and readily authenticated.

Furthermore, what is needed in the art is an original document with improved security features and a document protection method and apparatus that enables both authentication and detection of an unauthorized copy of such an original document.

Moreover, what is needed in the art is an original document with improved security features and a document protection method and apparatus that are effective while being relatively inexpensive, and relatively expedient and simple to implement, revise and adapt.

SUMMARY OF THE INVENTION

The present invention provides a security document and a method and apparatus for printing and authenticating such a document. "Document" for purposes of our invention is defined to include any article having a printable surface on any substrate, including identification and credit cards, packaging, labels and hang tags, name and data plates, as well as articles printed on papers, foils, and/or plastic sheets and normally regarded as documents.

The invention comprises, in one form thereof, a document security feature that is printed onto a print surface of a document and which is substantially invisible to the unaided eye. The document security feature includes a first design/background pattern printed in one color and at least one additional design/background pattern printed in a second color and superimposed on the first design/background pattern. The patterns are designed not to be reproducible by copiers or scanners, but can be detected in an original document with the aid of a detection device to authenticate the document.

An advantage of the present invention is that an original document is simply, readily and definitively authenticated as an original document.

Another advantage of the present invention is that is relatively simple to implement, revise and adapt.

Yet another advantage of the present invention is that it renders unauthorized reproduction of original documents substantially more difficult.

Other advantages of the present invention will be obvious to one skilled in the art and/or appear hereinafter.

BRIEF DESCRIPTION OF THE DRAWINGS

The above-mentioned and other features and advantages of this invention, and the manner of attaining them, will become appreciated and be more readily understood by reference to the following detailed description of one embodiment of the invention in conjunction with the accompanying drawings, wherein.

Corresponding reference characters indicate corresponding parts throughout the several views. The example set out herein illustrates one preferred embodiment of the invention, in one form, and is not to be construed as limiting the scope of the invention.

DETAILED DESCRIPTION OF THE DRAWINGS

Figure 1:
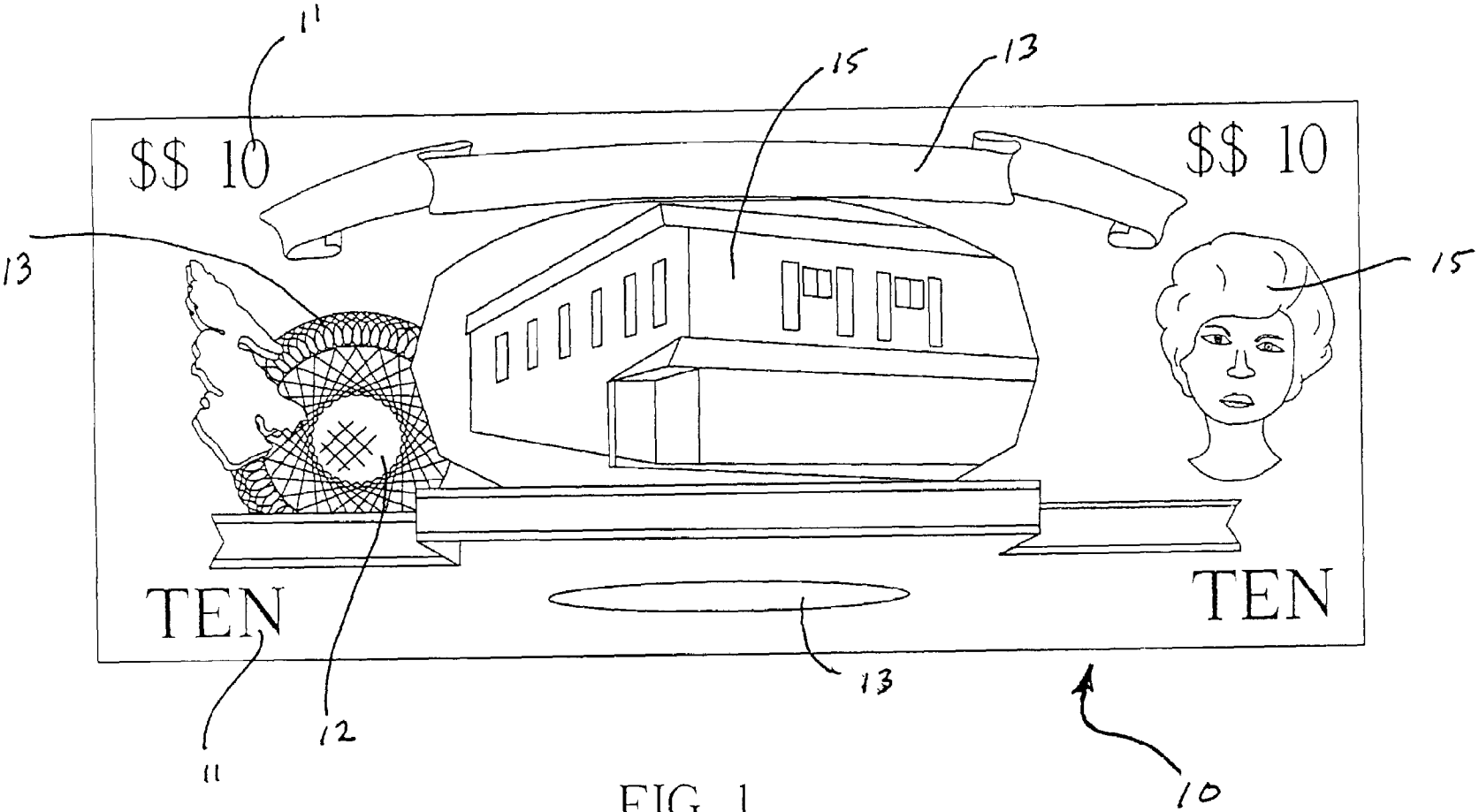
FIG. 1 is a view of the face an original document printed according to one embodiment of the method of the present invention.

Referring now to the drawings, and particularly to FIG. 1, there is shown a document 10 printed according to one embodiment of the method of the present invention. In the embodiment shown, document 10 is in the form of currency. However, it is to be understood that document 10 and the method for printing and authenticating original documents of the present invention are suitable for use with virtually any document printed in at least two colors on plain, security or otherwise featured paper or other substrate. Document 10 includes typical printed features for security documents, such as indicia 11 comprising letters and numbers, various geometric patterns 13, and illustrations or other line art 15. As illustrated, the invention comprising the security feature is incorporated in the inner portion 12 of one of the geometric patterns 13. The document 10 is printed in at least two colors but may be printed in up to six colors if more complex security features are desired. For purposes on simplicity, however, only two colors are illustrated, it being understood that the invention also may be replicated with the same or different designs in the additional colors.

Figure 2:
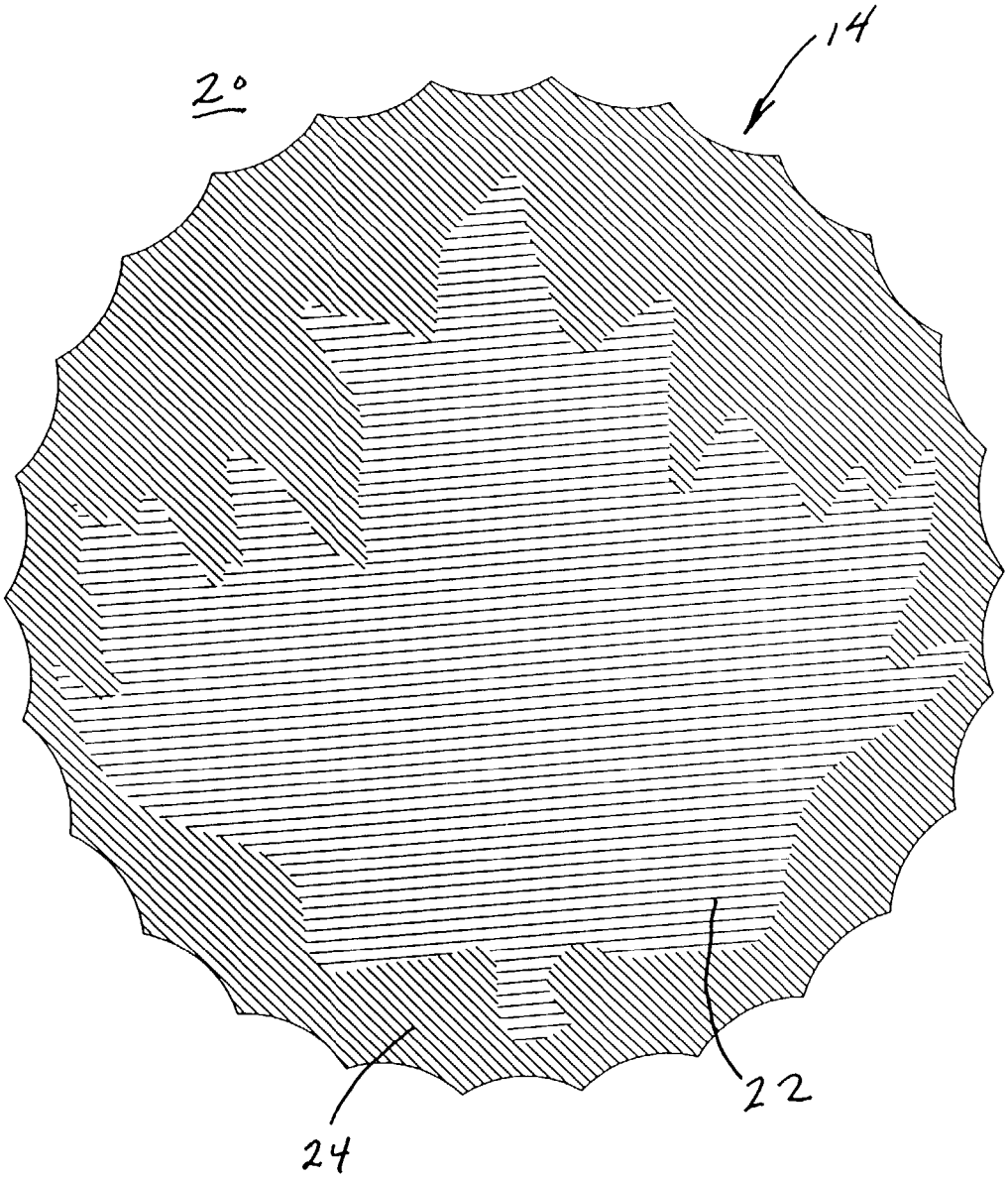
FIG. 2 is an enlarged view of part of a one-color separation print illustrating one image/background pattern in one portion of the document of FIG. 1.

Referring now to FIG. 2, inner portion 12 of pattern 13 is enlarged to show the details of security feature pattern 14 as is printed in one subtractive color in color separation 20 according to a preferred embodiment of the invention. As shown, the pattern 14 consists of an image in the shape of a maple leaf printed in continuous parallel lines 22 at one predetermined angle within a background of continuous parallel lines 24 in the same color and at a different predetermined angle. The image and background may be of any desired shape and the lines either parallel and substantially straight lines that are either continuous or dash lines or combinations of continuous and dash lines.

Figure 3:
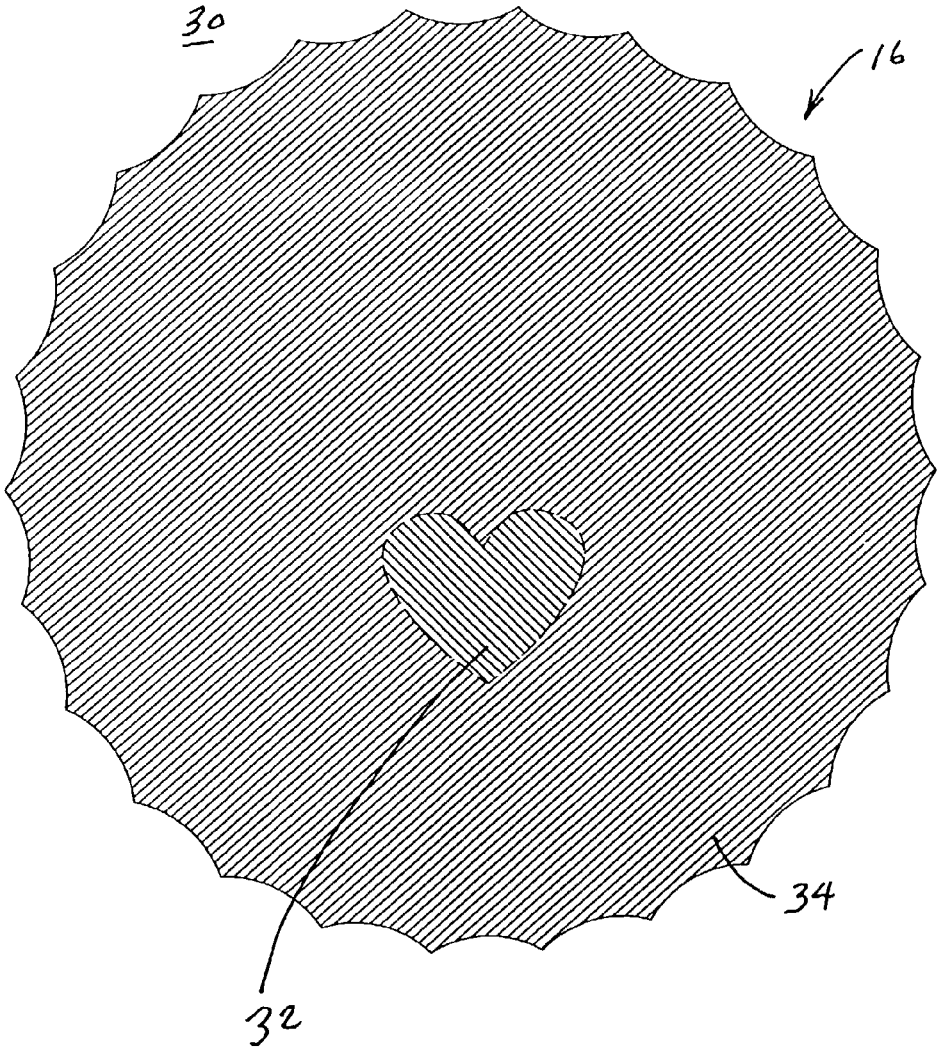
FIG. 3 is an enlarged view of part of a second one-color separation print illustrating another image/background pattern in the same portion of the document of FIG. 1.

Referring now to FIG. 3, which also is an enlargement of the same inner portion 12, there is shown the details of security feature pattern 16 printed in a second subtractive color ink in color separation 30, in which an image of a heart in pattern 16 as shown also is composed of continuous parallel lines 32 at still another predetermined angle within a background of continuous parallel lines 34 in the same color and at yet a different predetermined angle. Again, the image may be of any desired shape, and while the backgrounds of FIGS. 2 and 3 preferably have a common outline, the outlines may differ if useful for artistic reasons as long as the portions of the background common to the security features are generally identical so as to present a common color formed from the two subtractive color inks or dyes when the document is printed. The lines are printed preferably using subtractive color inks or dyes and the patterns made of parallel and substantially straight lines that are either continuous or dash lines or combinations of continuous and dash lines appropriate to the desired images but still be substantially invisible to the unaided eye work according to the invention.

The subtractive inks or dyes themselves may be printed in any reasonable tint to produce a final product of the desired colors perceived from the combination of the color separations. For example, a tint of about fifteen percent each for the cyan and magenta inks of the embodiment shown is very satisfactory to produce the desired results.

Figure 4:
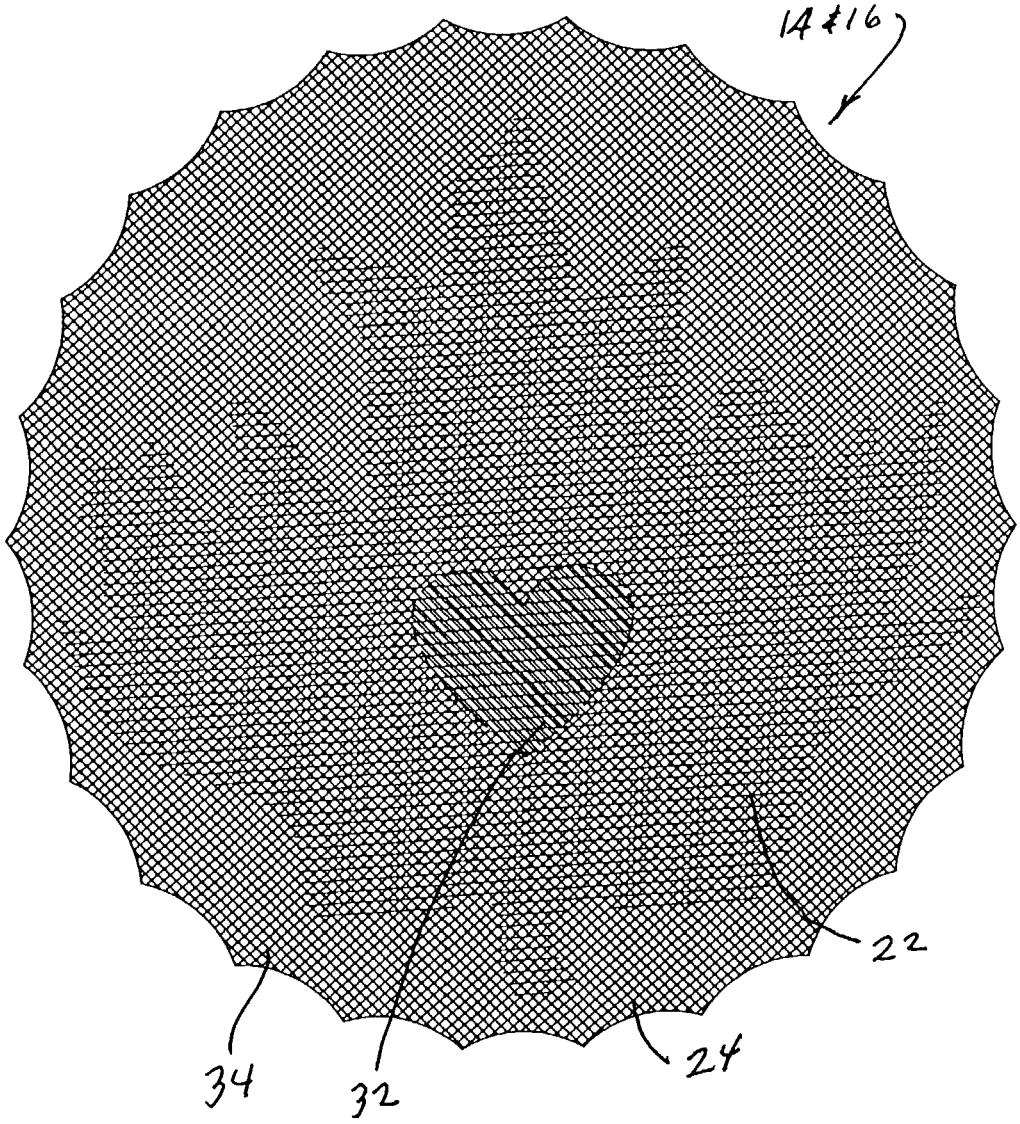
FIG. 4 is an enlarged view showing the combined two-color printing of both separation prints of FIGS. 2 and 3.

FIG. 4 illustrates the security feature 12 formed by first printing one of the color separations incorporating either pattern 14 or 16 and then overprinting with the second color separation incorporating the other pattern 14, 16 with the second pattern directly superimposed on the first pattern 14, 16 and in which the design forming lines 22, 32 and the background lines 24, 34 are thus printed as shown. For example, if the first color separation containing pattern 14 is printed in cyan and the separation containing pattern 16 is printed in magenta, the resulting security feature 12 will appear to have an overall bluish color depending on the respective print densities of the cyan and magenta inks or dyes. It will be understood, however, that any combinations of colors may be used that are consistent with the intended graphic design of document 10 and which in combination will generally conceal the superimposed patterns when viewed by the naked eye.

Referring more specifically to each of FIGS. 2 and 3, each of the image forming lines 22, 32 and background forming lines 24, 34 will have a predetermined pitch or spacing, a predetermined line density and width, and will be printed at a predetermined image angle.

As shown, each of the sets of lines 22, 24, 32, 34 are printed at a pitch of about 180 lines per inch, but may be printed at the same or different pitches of between from about ten lines per inch to about four hundred lines per inch, and preferably from about seventy-five to about two hundred lines per inch, and most preferably from about one hundred sixty to about one-hundred ninety lines per inch. Although the lines 22, 24, 32, 34 are shown to have the same pitch, the pitch for each of the sets of lines may differ from the other sets of lines as long as all of the sets of lines fall within the stated pitch ranges.

Similarly, each of the sets of lines 22, 24, 32, 34 are shown as printed at between about fifteen percent and about twenty percent density as represented by the total area of the lines in comparison to the total area of both the lines and the "white" spaces separating the lines. However, the densities as with the pitches may differ among the sets of lines, and further each set of lines may be printed in a specific density within a range from about two percent to about ninety eight percent density. Preferably also, the image and background lines 22, 24 of pattern 14 have substantially the same pitch and density, and the image and background lines 32, 34 have substantially the same pitch and density although not necessarily the same as lines 22, 24.

Also according to the invention, each of the sets of lines 22, 24, 32, 34 are to be printed at different angles from each other in order for the invention to work. As shown, image lines 22 are printed at a first angle of approximately ninety degrees from the vertical and background lines 32 at about 150 degrees. Image lines 32 are printed at about 135 degrees with background lines at about fifty degrees from the vertical. The endpoints (not referenced) of image lines 22, 32 form the general outline of the desired image shape.

For the invention to work best, the various image and background lines should be printed with angle separations at least between about fifteen to about twenty degrees, relative to the next closest angle. Thus, if four security patterns in four different subtractive colors were to be superimposed in a security feature, the relative angles, for example, may appear as follows:

| Color | Image | Background |
|---|---|---|
| 1 | 0° | 150° |
| 2 | 105° | 120° |
| 3 | 45° | 65° |
| 4 | 20° | 85° |

Referring again to FIG. 4, and as stated before, security patterns 14 and 16 are superimposed, i.e., image indicia 22 and 32 and background indicia 24 and 34 are printed within the same area of the print surface of document 10. While the security feature is located in a geometric pattern 13, it may also be located in indicia areas 11 and illustration areas 15 and in the same or different color inks or dyes, if those latter areas at least in part are printed in half-tone line patterns as are shown by security patterns 14, 16.

Figure 5A:
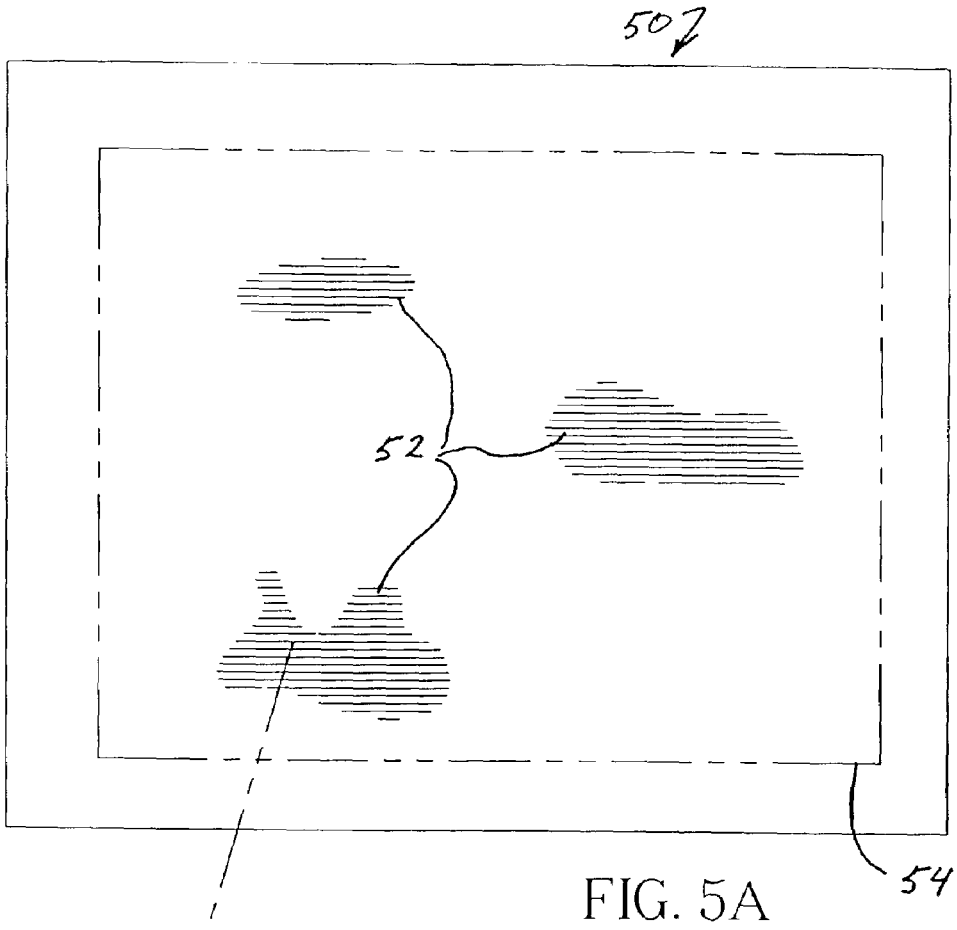
FIG. 5A is a perspective view of one embodiment of a decoder for use with the method of the present invention.
Figure 5B:
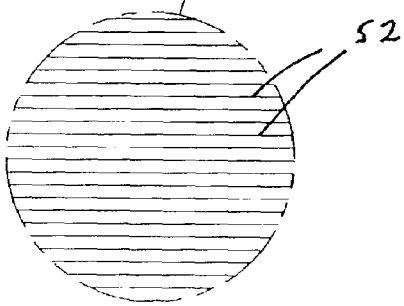
FIG. 5B is an enlarged detail view showing the decoder lines of the decoder of FIG. 5A.

To illustrate one method of detecting a genuine security document, there is illustrated in FIGS. 5A and 5B. a flat decoder 50 device of a clear or at least translucent and stable material, such as an acrylic plastic. Over an entire area 54 of decoder 50 within the dashed line, but only partially illustrated in FIG. 5A, there are etched or engraved on one side in a continuous pattern over the 54 a plurality of uniformly spaced lines 52 that have a pitch of between about three to about five lines per inch different from the pitches or from a "multiple" of the pitches of the pattern lines in the document 10. By "multiple" is meant the pitch of the pattern lines multiplied either by a whole number or by a fraction of one-half and its multiples. For example, if the line pitch of the security patterns in document 10 is 200 lines per inch, the pitch of the lines 52 etched in the decoder 50 may be, e.g., either about 95 lines per inch or about 103 lines per inch, or about three to five degrees from a pitch of one hundred.

Figure 6:
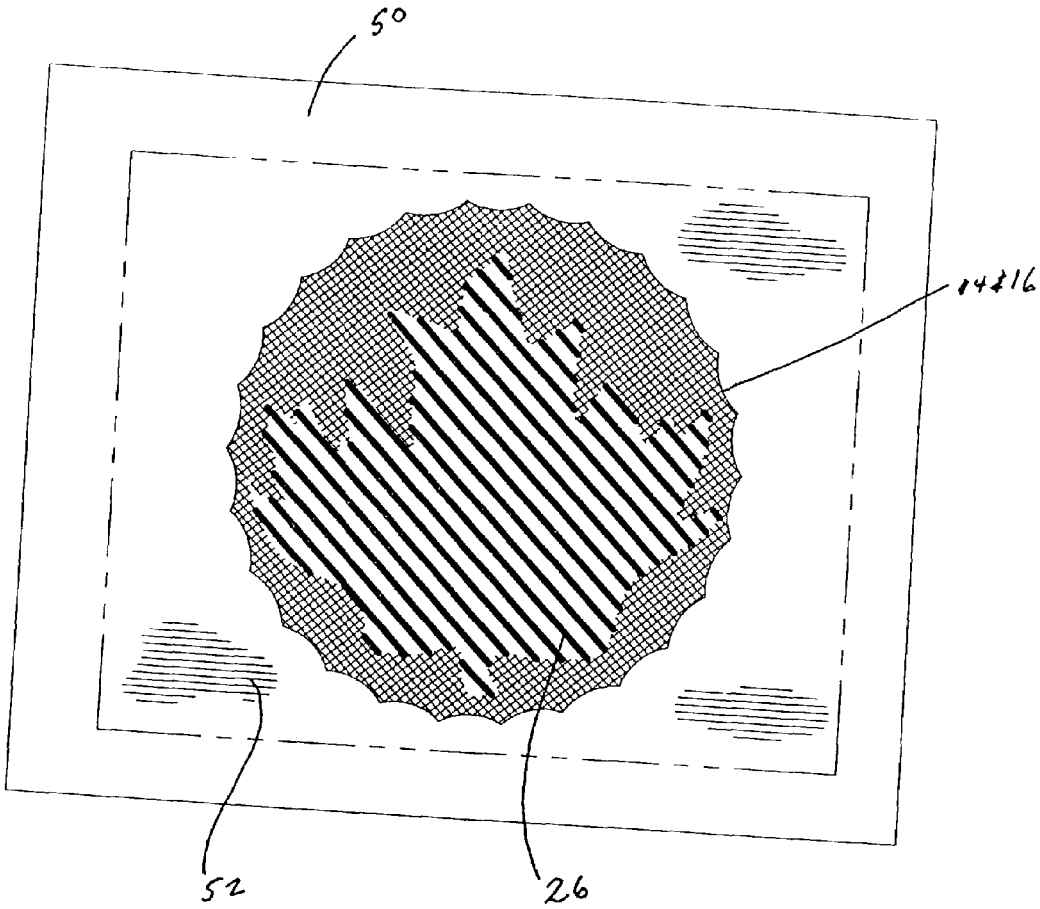
FIG. 6 is a view of the decoder of FIG. 5A superimposed on a portion of the document of FIG. 1 and oriented to reveal the image pattern of FIG. 2.
Figure 7:
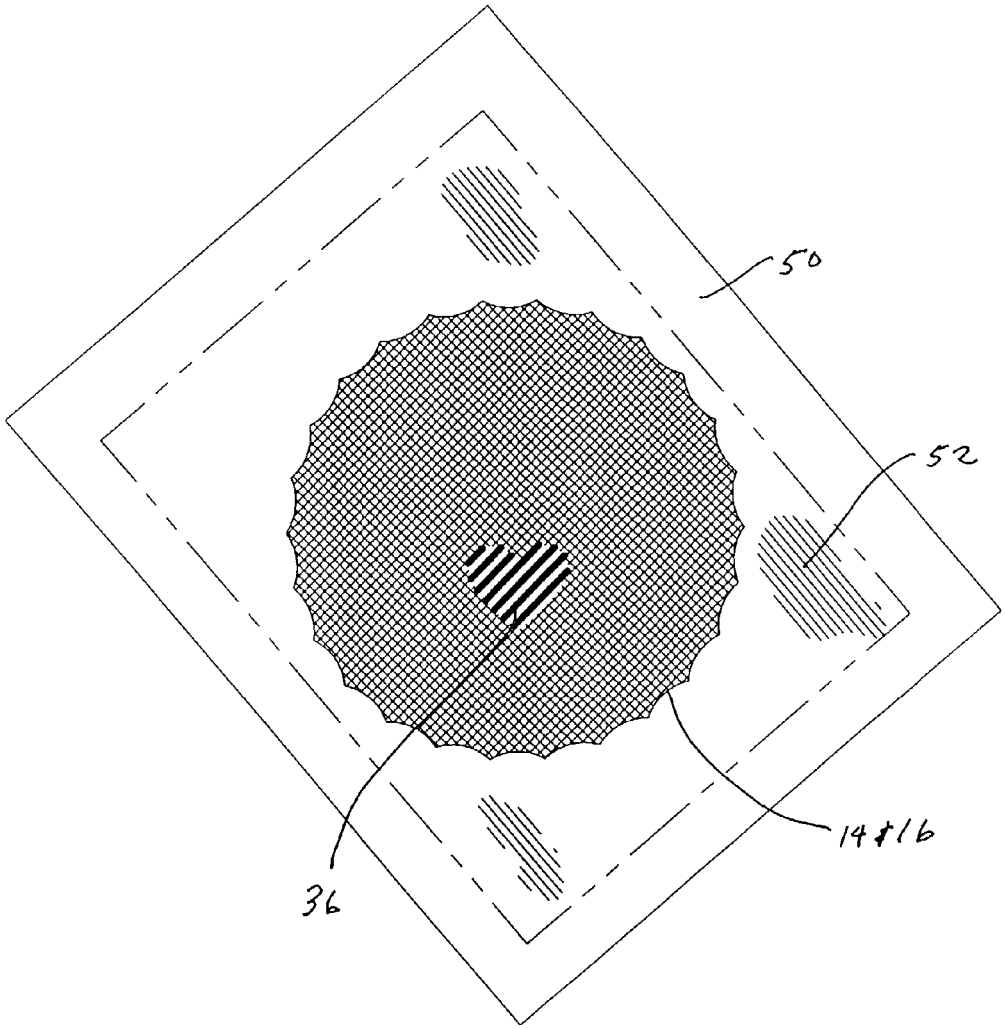
FIG. 7 is a view of the decoder of FIG. 5A superimposed on the same portion of the document of FIG. 1 and oriented to reveal the image pattern of FIG. 3.

In use, and with reference to FIGS. 6-7, security patterns 14 and 16 of document 10 which are nearly invisible to the unaided eye are simply and expediently revealed with the use of decoder 50. Decoder 50, when placed over and oriented at approximately the same angle as either one of image lines 22, 32, reveals that corresponding image to the naked eye by a very distinct and visible moire pattern of lines approximating the image shape. Thus, as shown in FIG. 6, placing decoder 50 over document 10 at security feature 12 and orienting decoder indicia 52 at about ninety degrees relative to the vertical reveals the maple leaf image in security pattern 14 by the moire pattern 26. As shown in FIG. 7, shifting the angular orientation of decoder 50 to approximately 135 degrees reveals the heart shaped image in security pattern 16, by the moire pattern 36.

Moreover, as it can be seen from FIG. 4, the overall line density of even two color layers makes it extremely difficult if not impossible to make counterfeits that will successfully reproduce the security patterns 14, 16, whether with high resolution computer scanners or copier/duplicators. Thus, the intended moire patterns to highlight the hidden images will not be seen from an overlay of a decoder 50 on such a copy, thereby indicating that the document being tested is not an original security document.

It should be particularly noted that separating by a predetermined or minimum angle between the background and image lines of any one color and among the background and image lines of the second and subsequent colors enables the security patterns of each of the colors to be printed within or superimposed in the same document area without creating undesirable visual effects, such as, for example, a moire pattern on the original document. Such undesirable visual effects are avoided by separating the angular orientation of the image and background lines of different colors preferably by at least about twenty to about thirty degrees as shown above.

It should further be particularly noted that the image and background security pattern lines of the same color are separated most preferably by at least about fifteen to about twenty degrees. Similarly, the pattern lines of the different colors also are to be separated from each other by the same degree differences.

As noted earlier, security features according to the invention can also be incorporated within virtually any printed area such as lettering, numbering, half-tone line art or other printed features of the document. The printed lines of each set of lines may be substantially unbroken or continuous lines or line segments of substantially equal pitch and thickness, but the pitch and density between color separations may differ. Moreover, it is to be understood that the present invention can be alternately configured with various line patterns, such as discontinuous line segments or dashed lines of varying pitch, thicknesses, and of sufficient length to produce the desired moire patterns with the decoder. Also, if it is desired to have the flexibility of printing a document with various security patterns of different pitches that are not "multiples" of each other, it is possible to produce decoders with different sections to accommodate each of the "multiple" sets of image lines.

In addition, while the invention is described in terms of subtractive primary colors, it is equally possible to use other subtractive colors typically associated with color printing in the graphic arts of any number of colors and laminations, as long as the superimposed security patterns reside in at least two of the color separations and up to and including six of the color separations. Printing may be done by any known method capable of printing the intended lines, including offset, gravure, flexographic, and digital sheet and web presses.

In the embodiment shown, the security images of the present invention are revealed or made visible to the human eye by the decoder described and illustrated. Security images of the present invention also can be revealed and/or decoded by automated means, such as an optical scanner, with or without automatic feed of documents, connected to a computer running software that detects and indicates the presence or absence of the security images.

While this invention has been described as having a preferred design, the present invention can be further modified within the spirit and scope of this disclosure. This application is therefore intended to cover any variations, uses, or adaptations of the present invention using the general principles disclosed herein and which fall within the limits of the appended claims.

What is claimed:

1. In a document, a two-dimensional security feature to authenticate an original document and to defeat counterfeiting, the feature comprising a two-dimensional first image and a two-dimensional first background pattern printed in one color on a print surface of the document, and at least a two-dimensional second image and a two-dimensional second background pattern printed in another color on the print surface, the two-dimensional second image and the two-dimensional second background pattern printed being superimposed directly over the two-dimensional first image and the two-dimensional first background pattern, wherein said images and backgrounds are configured to generate a moiré pattern representing at least one of said images when viewed through a decoder orientated at a first angle relative to said first image.

2. The two dimensional security feature of claim 1, wherein the two-dimensional first image and the two-dimensional first background pattern is different from the two-dimensional second image and the two-dimensional second background pattern.

3. The two dimensional security feature of claim 1, wherein at least one of the two-dimensional image and two-dimensional background patterns comprises an image area of a defined shape represented by a set of substantially parallel lines of a specified pitch and density printed on the surface at a first angle, and a background area represented by a set of substantially parallel lines of a specified pitch and density printed on the surface at a second angle different from the first angle.

4. The two dimensional security feature of claim 3, wherein said two-dimensional first and two-dimensional second image angles are separated from each other by at least about fifteen degrees.

5. The two dimensional security feature of claim 3, wherein the other one of the two-dimensional image and two-dimensional background patterns comprises an image area of a different defined shape represented by a set of substantially parallel lines of a specified pitch and density printed on the surface at a third angle different from the first and second angles, and a background area represented by a set of substantially parallel lines of a specified pitch and density printed on the surface at a fourth angle different from the other three angles.

6. The two dimensional security feature of claim 5, wherein all of the first, second, third and fourth angles are separated from each other by at least about fifteen degrees.

7. The two dimensional security feature of claim 5 and further comprising at least a two-dimensional third image and a two-dimensional third background pattern printed in a third color and a two-dimensional fourth image and a two-dimensional fourth background pattern printed in a fourth color, each of which pattern is comprised of a different defined image shape of substantially parallel lines and a background area of substantially parallel lines of specified pitches and densities, the two-dimensional third and two-dimensional fourth image and two-dimensional third and two-dimensional fourth background patterns being superimposed on the two-dimensional first and two-dimensional second image and two-dimensional first and two-dimensional second background patterns and all of the parallel lines of the two-dimensional third and two-dimensional fourth image and two-dimensional third and two-dimensional fourth background patterns being different from each other and those of the two-dimensional first and two-dimensional second image and two-dimensional first and two-dimensional second background patterns.

8. The two dimensional security feature of claim 1 wherein each of the first and second colors is a subtractive color.

9. The two dimensional security feature of claim 5 wherein the parallel lines have a pitch within a range from about one hundred and twenty lines per inch to about four hundred lines per inch.

10. The two dimensional security feature of claim 5 wherein the parallel lines have a pitch within a range from about one hundred and twenty lines per inch to about two hundred lines per inch.

11. The two dimensional security feature of claim 10 wherein the parallel lines have a pitch within a range from about one hundred sixty lines per inch to about one hundred ninety lines per inch.

12. The two dimensional security feature of claim 1, wherein said image and background lines are continuous lines and/or discontinuous line segments.

13. The two dimensional security feature of claim 5, wherein said image and background lines have a density between about two percent and about ninety eight percent.

14. The two dimensional security feature of claim 13, wherein said image and background lines have a density between about fifteen percent and about twenty percent.

15. A method of printing a two dimensional security document that is readily authenticated as an original document, comprising printing a two-dimensional first image and a two-dimensional first background pattern in one color on a print surface of the document, then printing at least a two-dimensional second and two-dimensional different image and two-dimensional second background pattern in another color and superimposed directly over the two-dimensional first image and the two-dimensional first background pattern, wherein said images and backgrounds are configured to generate a moirépattern representing at least one of said images when viewed through a decoder orientated at a first angle relative to said first image.

16. The method of claim 15, wherein each of the two-dimensional image and two-dimensional background patterns comprises an image area of a defined shape represented by a set of substantially parallel lines of a specified pitch and density printed on the surface at a specified one angle, and a background area represented by a set of substantially parallel lines of a specified pitch and density printed on the surface at a specified angle, and in which all of the angle specifications of both of the two-dimensional image and two-dimensional background patterns are different from each other.

17. A method of authenticating a document comprising:

providing a document comprising a security feature comprising a two-dimensional first image and a two-dimensional first background pattern printed in one color on a print surface of the document and at least a two-dimensional second image and a two-dimensional second background pattern printed in another color on the print surface of the document, the two-dimensional second image and the two-dimensional second background pattern printed being superimposed directly over the two-dimensional first image and the two-dimensional first background pattern; and superimposing on the document a decoder and positioning the decoder to detect the two-dimensional first image and the two-dimensional first background pattern and then repositioning the decoder relative to the document to detect the two-dimensional second image and the two-dimensional second background pattern, wherein said images and backgrounds are configured to generate a moré pattern representing at least one of said images when viewed through said decoder orientated at a first angle relative to said first image.

18. The method of claim 17 wherein the decoder comprises a transparent or translucent card to enable a visual detection of the respective patterns.

19. The method of claim 17 wherein the decoder comprises a computer scanner to enable detection of the respective patterns by computer software and the positioning and repositioning comprises a virtual processes programmed within the software.

20. A method of authenticating a document according to claim 17, wherein a first one of the two-dimensional image and two-dimensional background patterns comprising an image area of a defined shape represented by a set of substantially parallel lines of a specific pitch and density printed on the surface of a first angle, and a background area represented by a set of substantially parallel lines of a specified pitch and density printed on the surface at a second angle different from the first angle; and wherein a second one of the two-dimensional image and two-dimensional background patterns comprises an image area of a different defined shape represented by a set of substantially parallel lines of a specified pitch and density printed on the surface at a third angle different from the first and second angles, and a background area represented by a set of substantially parallel lines of a specified pitch and density printed on the surface at a forth angle different from the other three angles.

21. The method according to claim 20, wherein the decoder is comprised of a transparent or translucent card having at least one set of etched or printed substantially parallel lines having a pitch different from the pitches of the printed lines or multiples thereof in an amount of about three to five lines per inch.

* * * * *